United States Patent [19]

Saunders

[11] Patent Number: 5,014,983

[45] Date of Patent: May 14, 1991

[54] PORTABLE OUTDOOR MULTI GAME APPARATUS

[76] Inventor: Raymond Saunders, 1100 N. Banning Blvd. #111, Wilmington, Calif. 90744

[21] Appl. No.: 329,969

[22] Filed: Mar. 29, 1989

[51] Int. Cl.[5] ..... A63B 63/08

[52] U.S. Cl. ..... 273/1.5 R; 273/29 BB; 273/411; 273/413; 248/156; 248/219.1; 248/219.4; 248/221.3; 403/334; 403/343

[58] Field of Search ..... 273/1.5 R, 1.5 A, 55 D, 273/411, 413, 26 A, 29 BB; 248/156, 219.4, 218.4, 221.3, 222.1, 295.1, 297.3, 219.1; 403/334, 343, 359, 375, 320

[56] References Cited

U.S. PATENT DOCUMENTS

| | | | |
|---|---|---|---|
| 430,685 | 6/1890 | Pymm | 403/343 X |
| 2,113,508 | 4/1938 | Guinn | 403/320 |
| 2,602,641 | 7/1952 | Wade | 403/343 X |
| 2,884,250 | 4/1959 | Patterson | 248/156 X |
| 3,105,682 | 10/1963 | Ahrens | 273/413 X |
| 3,776,549 | 12/1973 | Ganis | 273/1.5 R |
| 3,820,787 | 6/1974 | Heinbkner | 273/55 D |
| 3,870,351 | 3/1975 | Matsui | 403/343 X |
| 4,232,422 | 11/1980 | Fellmann | 403/343 X |
| 4,793,611 | 12/1988 | Thornell | 273/1.5 R |

FOREIGN PATENT DOCUMENTS

| | | | |
|---|---|---|---|
| 2321436 | 11/1974 | Fed. Rep. of Germany | 273/1.5 R |
| 262586 | 10/1949 | Switzerland | 248/156 |
| 242339 | 11/1925 | United Kingdom | 403/334 |

*Primary Examiner*—Paul E. Shapiro

*Attorney, Agent, or Firm*—Chris Papageorge

[57] ABSTRACT

A portable game apparatus is a kit which includes a lower stake member and a set of upper stake members. The members have threaded portions which allow the members to be securely joined together end to end. One of the upper members is structured to allow the upper members and lower member (when joined together) to be pounded into the ground. The upper member is detached from the lower member while the lower member remains embedded in the ground to provide a foundation for the other upper members which are specifically structured to allow various game structures such as volleyball nets, basketball nets and backboards as well as tether balls and ropes to be secured thereto. Truncated cone portions on the members (at their joined portions) add structural rigidity to the members, and ridge and groove structures secure the members in a desired joined together position.

4 Claims, 3 Drawing Sheets

Fig. 7.
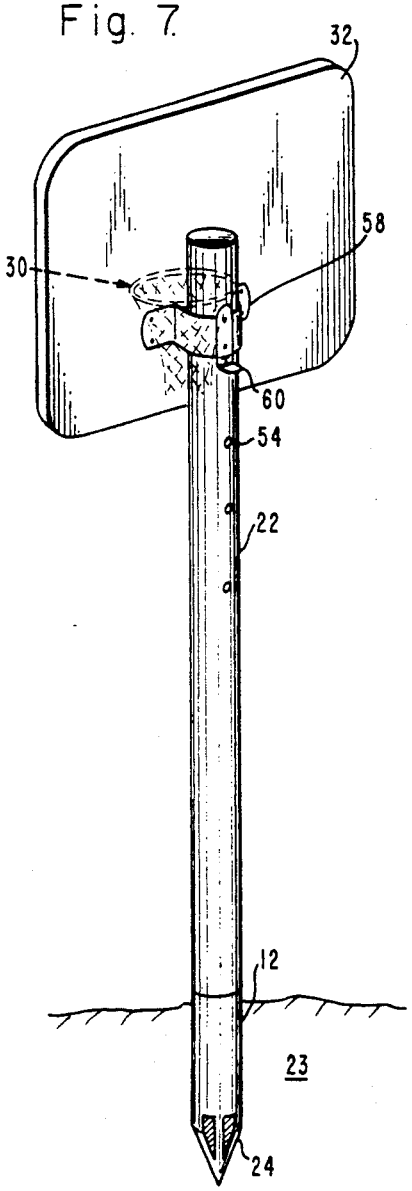
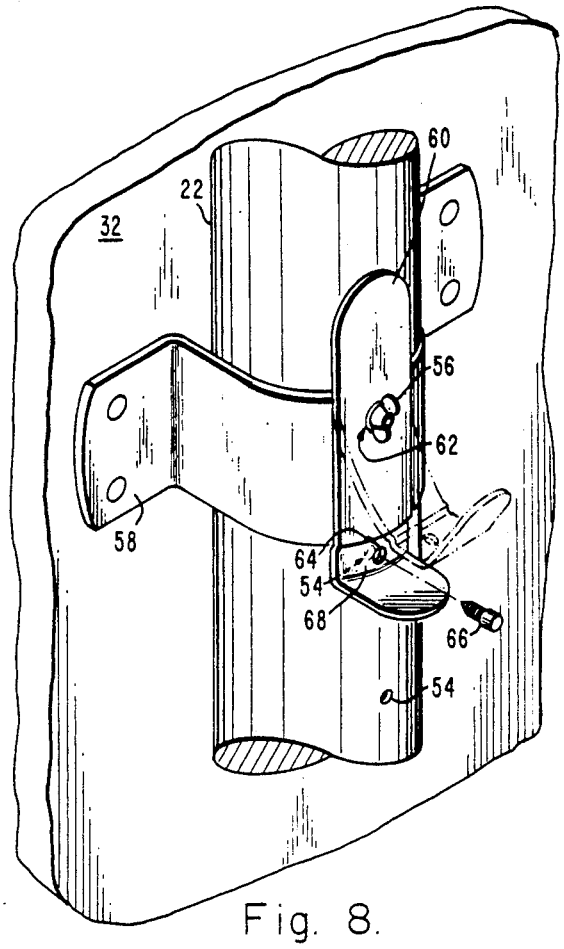
Fig. 8.

PORTABLE OUTDOOR MULTI GAME APPARATUS

BACKGROUND OF THE INVENTION

The invention relates generally to apparatus and apparatus fixtures used for supporting outdoor game activities and more particularly to a portable apparatus which is in kit form and which provides a variety of outdoor game apparatuses which can be set up in a variety of outdoor locales.

As is well known, many of the best locations for picnics and other outings do not have the game apparatuses and apparatus fixtures in place or otherwise provided to allow people to entertain themselves by playing volleyball, basketball, horseshoe pitching, etc. For this reason, many people choose to restrict their outing locales to only those locales which have such apparatus and apparatus fixtures in place. For the same reason, other people restrict the games played at such outings to those games which do not require any special apparatus or equipment. Consequently, many people at such outings find themselves playing simple and monotonous games such as "catch" with a beachball, softball, etc.

Many prior art game manufacturers have attempted to provide more and varied entertainment to people at such outings by introducing games which do not require special apparatus, fixtures or facilities. In general, such games involve the users tossing a ball or other such suitable article onto a ground surface or simply back and forth between the players. However, due to their simplicity, such games tend to get boring after a relatively short period of time.

Other prior art games for outdoor use are designed to reduce the speed or distance which the article thrown (or propelled by other means) back and forth can travel. Thus, such games can be used without special equipment, apparatus and apparatus fixtures and in a relatively constricted area. In some of these games the article thrown is designed to have certain aerodynamic features enabling it to change direction in flight thereby adding to its uniqueness and entertainment value. However, the simplicity of such games and the slowness with which such game articles move detracts from the enjoyment of the games to the extent that the users may feel they are playing a children's game.

Designers of some outdoor game apparatus and equipment have made some components thereof removable from fixtures to which they are attached. Such equipment is thus provided with a certain degree of portability. In addition, the removability of such components allows the equipment to be used to support the playing of more than one type of game. Such equipment typically includes a concrete footing in which a metal sleeve is inserted and permanently anchored. After the metal sleeve is anchored, a removable post is inserted within the sleeve and secured thereto by means of a reducing bushing. A primary disadvantage with such prior art designs, however, is that they require a substantial amount of excavation and a large concrete footing to permanently secure and anchor the sleeve. Thus, such prior art designs essentially require a more elaborate and complex set up than those which do not have removable posts and increase the cost of an otherwise costly set up for outdoor games such as basketball, volleyball, etc. In addition, the elaborate set up makes such designs inappropriate and impractical at many beaches and other public outing locations. Moreover, since a significant or substantial amount of manual labor using special tools is required to remove and substitute the original post with another, such prior art systems cannot be used by individuals at their outings at locales such as beaches, campgrounds, etc.

Some prior art outdoor game apparatuses are designed to be set up by the users at the playing site. Many such prior art apparatuses have component stakes and tubular posts to which a game net is attached. A primary disadvantage with such an apparatus is that it can only support one type of game activity. If the user desires to play more than one type of game, he is required to purchase and bring to the playing site other such prior art devices designed to support other game activities. In addition, since the components are secured together simply by the insertion of one component into another tubular component, the resulting foundational structure may not have sufficient structural strength, rigidity or stability to support many outdoor game structures and also may not be able to withstand the forces to which they will be subjected by normal game playing activities.

Other prior art game apparatuses which are designed for portability and/or mobility have component parts which are assembled at the playing site. In order to provide a firm foundation for the basketball net and backboard, such games have multiple posts (or legs) which may have wheels or rollers in order to move the apparatus around on the playing floor. However, such prior art games have the primary disadvantage that they must be used indoors because their wheeled legs render them generally unsuitable for outdoor ground surfaces. Moreover, the typically 3 or 4 legs add excessive dimensional size to the base of the game apparatus rendering it more likely that a player will bump into the legs casing injury. Since a regulation basketball game apparatus has only one post, the players are not accustomed to playing with a game having such a large base and the players are therefore more likely to run into the legs. Due to the size of the base, such prior art games are likely to interfere with the game playing activities. In addition, due to their many parts and the structural strength necessitated thereby, a substantial amount of manual labor utilizing special tools is required to assemble such prior art devices. Moreover, such a large number of parts make such prior art games very heavy and bulky for the users to transport. Thus, such devices have limited portability and are not generally taken to beaches, parks, and campgrounds but instead remain indoors where they are pulled out of a storage area when their use is desired. Moreover, such devices can only support one particular type of game activity necessitating that many such devices be purchased if multiple games will be played.

A portable multiple game apparatus is thus needed which has a minimum number of assemblable parts with a dimensionally small foundation so as not to interfere with or hinder game playing movements of the players. Moreover, a game apparatus is needed that can be used on various types of natural outdoor ground surfaces such as dirt, sand or grass and that can support various types of outdoor game activities. In addition, a portable game apparatus is needed that is relatively lightweight and does not require any special tools or expertise to assemble and properly set up. A game apparatus is further needed that provides a firm, stable support for various specialized game structures such as volleyball nets and basketball goals and has sufficient structural strength to withstand forces to which it might be subjected by normal game playing activities.

SUMMARY OF THE INVENTION

It is a principal object of the present invention to provide a game apparatus which can support a variety of game activities.

It is another object of the present invention to provide a game apparatus which can be used on many natural outdoor ground surfaces.

It is another object of the present invention to provide a game apparatus which can be assembled from a minimal number of component parts.

It is also another object of the present invention to provide a game apparatus which is dimensionally small at its lower portions in order to minimize hindrance with physical movement of the game players using the apparatus.

It is still another object of the present invention to provide a portable game apparatus which is compact when in kit form so as to render it less bulky and thus more convenient for the user to transport to and from the game playing site.

It is yet another object of the present invention to provide a game apparatus which can be manually assembled and set up by the user simply and conveniently without the use of any special tools.

It is also an object of the present invention to provide a game apparatus which is stable when assembled and properly set up to minimize the likelihood that the game apparatus will be knocked over, displaced or otherwise moved from its desired position.

The apparatus of the present invention is specifically designed to support any one of a variety of games on various types of outdoor ground surfaces such as sand, dirt or grass at various playing sites such as, for example, parks, beaches, campgrounds, etc. An important feature of the invention is that it can support a variety of outdoor game activities such as tether ball, badminton, volleyball and horseshoe pitching with a minimal number of component parts. It accomplishes this by utilizing a single lower stake component onto which are secured various upper stake components specifically adapted to support one (or more) specific game activities. In addition, the unique connecting structures of the upper and lower components allow the user to firmly secure these components together without the use of any tools resulting in a game apparatus with sufficiently good stability to adequately withstand the forces, stresses or shocks thereto resulting from the game activities.

Generally, the invention has a lower stake member and an upper stake member which are manually joined together and separated without the use of tools. Once the members are securely joined together, the resulting stake structure is sufficiently rigid to be simply and easily hammered into the ground. Once embedded in the ground (to a desired depth), the upper member may be detached from the lower member and replaced with another upper member which is specifically adapted to allow a selected type of game structure such as a volleyball net to be secured thereto. Other upper members adapted to support other game structures can similarly be interchangeably joined to the lower member allowing the apparatus to support a variety of outdoor game activities.

After cessation of the game playing activities, the stake may be simply pulled out of the ground and disassembled. Once disassembled, the apparatus is in a compact form allowing it to be packed into a bag or box and taken home with the user. The user may select the particular upper members he will take along to the playing site according to which games the user expects to play in order to minimize the number of components which will have to be transported to the playing site. Nevertheless, the number of component parts is very small considering the variety of games which the apparatus will support. In addition, the ease with which the apparatus can allow the user to switch from one game activity to another makes the apparatus very practical for people who spend much of their time outdoors. Consequently, the apparatus is both very portable and very versatile and therefore ideally suited for bringing to beaches and campgrounds. The apparatus can easily be set up on sandy beaches as well as the dirt and grassy ground surfaces of parks, forests or campgrounds. Thus, the apparatus allows people to play various outdoor games at areas at which a lack of existing permanent game facilities and apparatus fixtures would have otherwise precluded them from engaging in such activities.

From the foregoing, it is evident that the apparatus of the present invention is essentially in kit form. The kit design enables the multipurpose game apparatus of the present invention to be broken down and transported in a very compact form thereby minimizing the space taken up by the apparatus when not in use and further enabling the entire apparatus to be carried by one person. This compactness and portability further enhances the invention's unique feature of providing a single kit which provides a multitude of game playing structures (or subapparatuses). Thus, the user does not have to determine which particular (single) game he and his friends will want to play when at the beach or other site but instead can bring the apparatus of the present invention to the site and allow all participants to play any one of a variety of games in any order desired. Once the lower stake member is firmly embedded in the ground, the various upper stake members can be interchangeably connected to the lower stake member relatively quickly, conveniently and easily allowing the participants to direct more of their energies to their game playing activities. Thus, the apparatus of the present invention greatly enhances the enjoyment of people using beaches, picnic areas and campgrounds.

BRIEF DESCRIPTION OF THE DRAWINGS

FIG. 7 is a perspective back View of the apparatus of the present invention illustrating the particular upper member depicted in FIG. 6 designed for use with a game backboard utilizing only one pair of upper and lower members.

FIG 8 is a perspective view of the particular upper member depicted in FIGS. 5 and 6 showing in detail the bracket and related structures which secure the upper member to the backboard.

DETAILED DESCRIPTION OF THE PREFERRED EMBODIMENT

Figure 1:
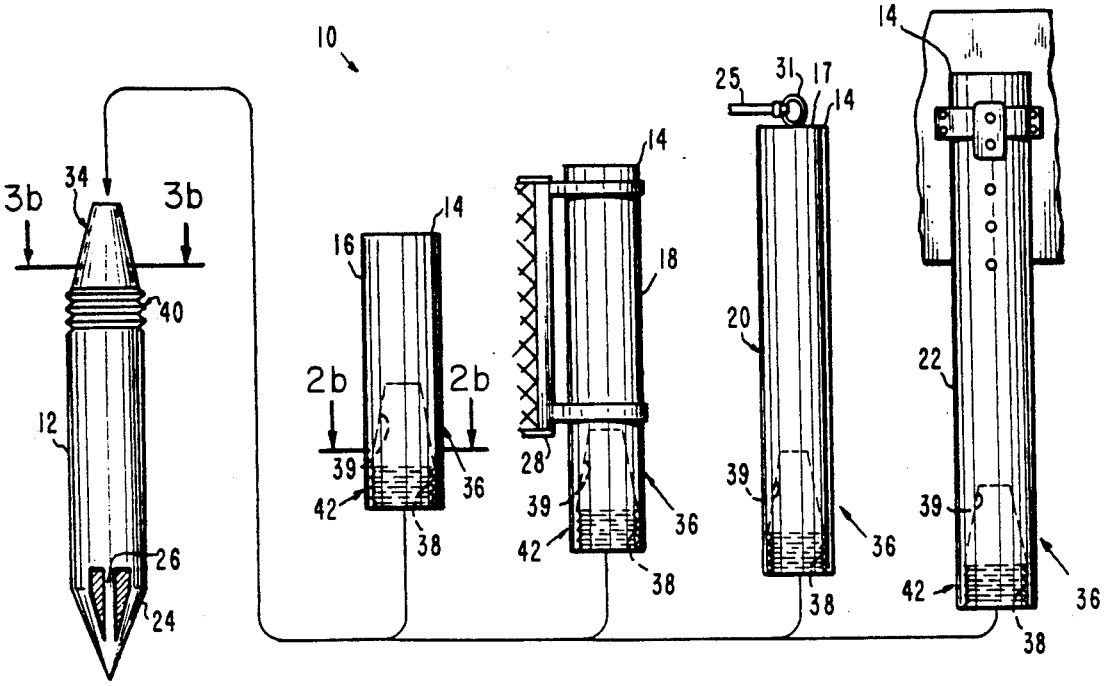
FIG. 1 is an elevational view of the invention showing the lower stake member and a set of upper stake members separated from the lower member in order to more clearly illustrate the structure which allows the members to be joined together and showing the game structures with portions thereof broken away for simplicity of illustration.

Referring to the drawings, the apparatus of the present invention is generally designated by the numeral 10. The apparatus or kit 10 of the present invention includes a lower stake member 12 and a set 14 of upper stake members. Each of the set 14 is detachably joinable to the lower member 12. Lower stake member 12 and each of the set 14 are preferably generally cylindrically shaped.

A 1st upper member 16 of the set 14 is joinable to the lower member 12 to form a generally rigid stake structure which can be driven into a ground-surface 23. The 1st member 16 is preferably composed of a hard material or has a top surface 17 which is composed of a hard material and is otherwise structurally rigid so that the 1st member 16 and the lower member 12 can withstand the pounding forces required to drive them into a suitable ground surface 23. Lower end section 24 of lower stake member 12 is preferably tapered so that member 12 can be more easily driven into the ground surface 23. More specifically, section 24 is preferably generally conical so that it can be driven into the ground surface 23 with a minimum of effort. In addition, lower section 26 is preferably provided with fins or ribs 26 to enhance the members' stability and prevent them from toppling over or bending over when subjected to the stresses of use. The ribs 26 also enable the members to be driven generally straight into the ground. In addition, the ribs 26 enhance the members' stability when embedded in a ground surface which is composed of sand, mud or other type of loosely packed or otherwise yielding composition.

Once the members 12 and 16 are driven into the ground surface 23 to a desired depth, the 1st upper member 16 may be detached preferably unscrewed) from the lower member leaving the member 12 embedded in the ground 23. Another upper member selected from the set 14 may subsequently be connected to the lower member 12 in order to provide a structure (or subapparatus) which can support a desired game activity. The upper members of the set 14 are all generally interchangeable to allow the user to change the upper members at will in order to set up the apparatus for a selected one of a variety of games which the apparatus can accommodate. This unique interchangeability feature not only minimizes the total number of component parts required to support the game activities, but also reduces the total amount of physical work required by the user in order to set up the apparatus 10 for the various games to be played. Once the lower member 12 is properly and securely embedded in the ground 23, any one of the upper members of set 14 may be simply and interchangeably secured to the lower member 12 as desired (with the desired game structure attached to its particular upper member) in order to set up the apparatus for the desired game activities with a minimum of work involved.

The set 14 preferably includes a second upper member adapted to accommodate a volleyball net, a third upper member 20 adapted to accommodate a tether ball game structure and a fourth upper member 22 adapted to accommodate a basketball game structure. Upper members 18, 20 and 22 will be described in detail hereinbelow. Although members 16, 18, 20 and 22 are the preferred members of the set 14, there may also be other upper stake members (or fewer upper stake members) which are specifically constructed to be attached to other game structures in order to support other game activities. For example, another upper member may be provided which when combined with lower member 12 may be used (in combination) as a horseshoe pitching target post. Alternatively, members 12 and 16 when joined together may also be used as such a target post, if desired.

Each of the upper members of the set 14 is detachably joined to lower stake member 12 preferably by means of mating threaded portions on the members 12 and 14. Lower member 12 has an upper medial portion 40 an outer surface of which is preferably threaded so that it mates with corresponding threaded inner surfaces of lower end portion 42 of each of set 14. The inner surfaces of lower end portion 42 at least partially define a recess 38. Other suitable detachable joining means may also be utilized instead of threaded portions 40 and 42.

In order to enhance the upper and lower members' rigidity and structural strength when joined together, the lower member has an upper end portion 34 which has a preferably conical (or more preferably a truncated cone shape) which is dimensioned to fit within a corresponding similarly conically shaped upper recess portion 39 of lower medial portion 36 of each of the set 14 (or more preferably truncated cone shaped recess 39 which is defined by inner surfaces of lower medial portion 36). With these unique tapered structures, the upper and lower members 12 and 14 can be more firmly secured together so that they have enhanced rigidity and structural strength reducing the likelihood that they will come loose or bend during use. Consequently, the members 12 and 16 are more capable of withstanding not only the repeated pounding necessary to drive them into the ground surface but also the shocks and other forces to which they may be subjected when used to support the game structures or when otherwise used to support game activities (for example, when hit by horseshoes while used as a horseshoe pitching target post.

Figure 2A:
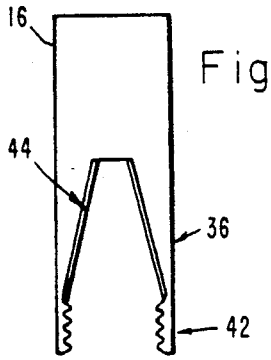
FIG. 2*a* is a longitudinal axial sectional view of the first upper member (generally representative of the other upper members also) of FIG. 1 showing a component part of the locking structure in detail.
Figure 2B:
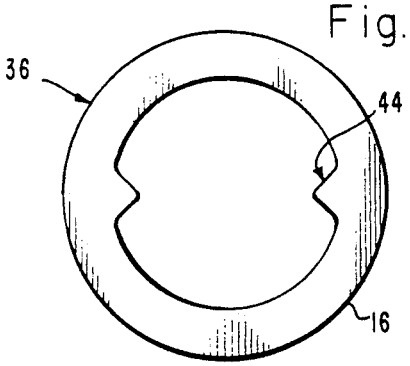
FIG. 2*b* is a crossectional view of the first upper member of FIG. 1 showing a component part of the locking structure in detail.
Figure 3A:
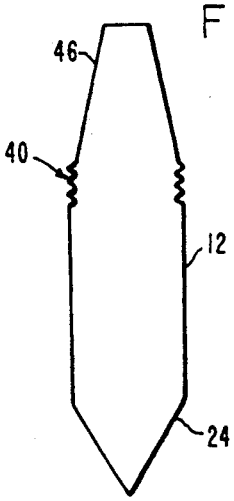
FIG. 3*a* is a longitudinal axial sectional view of the lower member of FIG. 1 showing the other component part of the locking structure in detail.
Figure 3B:
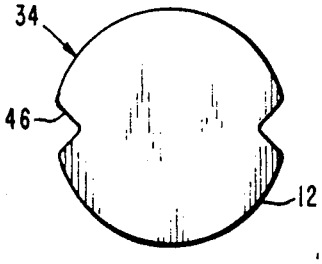
FIG. 3*b* is a crossectional view of the lower member of FIG. 1 showing the other component part of the locking structure in detail.

A locking means is provided to prevent the upper and lower members 12 and 14 from loosening when joined together. The locking means includes a ridge 44 on the inner surface of truncated cone shaped lower medial portion 36 (as shown in FIGS. 2*a* and 2*b*) which fits into a groove 46 on the truncated cone shaped upper end portion 34 (as shown in FIGS. 3*a* and 3*b*). Ridge 44 and groove 46 extend to but not into the threaded portions 40 and 42 of members 12 and 14. The ridge 44 and groove 46 are preferably a pair of diametrically opposed ridges 44 and a pair of diametrically opposed grooves 46 which preferably extend generally longitudinally on the portions 34 and 36. The ridges 44 and grooves 46 are preferably dimensioned and matched with the coarseness of the threads so that the ridges 44 do not fit into the corresponding grooves 46 until the upper and lower members 12 and 14 are in a desired joined together position such that the upper end portion 34 fits snugly within the recess 39 so that the upper and lower members 12 and 14 are firmly joined together. The coarseness of the threads is preferably matched to the dimensions of the ridges and grooves e.g. coarse threads are matched with dimensionally high ridges and deep grooves and fine threads are matched with low ridges and shallow grooves. Coarse threads and high ridges and deep grooves, in addition to wide ridges and grooves, may be provided where a higher degree of locking securement is required in order that the stake can withstand greater rotational forces applied thereto while the stake is being driven into the ground surface 23 or during game playing activities. Although the ridges 44 and grooves 46 preferably extend in a generally straight line longitudinally, they may also be oblique to the longitudinal axial planes of the upper and lower members 12 and 14. In addition, there may be more than a pair of ridges 44 and more than a pair of grooves 46, if desired.

Figure 4:
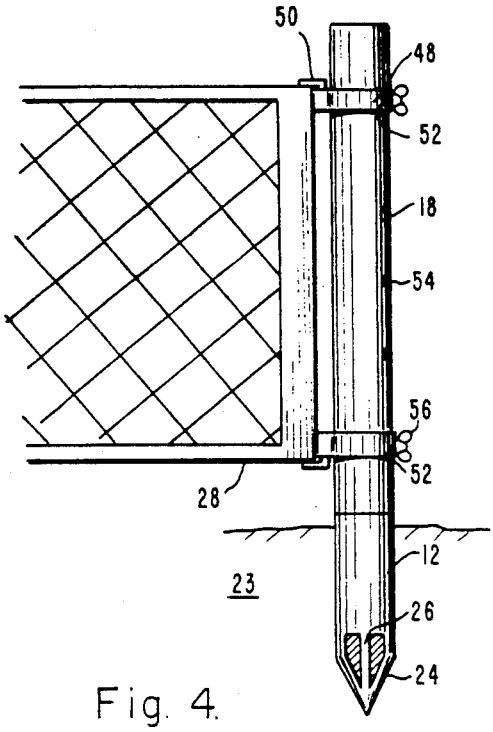
FIG. 4 is an elevational view of the apparatus of the present invention illustrating a second particular upper member designed for use with a game net (broken away for simplicity of illustration) shown secured thereto.

The 2nd upper member 18 is preferably connected to volleyball net 28 by means of a collar type bracket 48 which allows detachable securement of the 2nd upper member 18 to the game net 28. The collar bracket 48 preferably has an apertured arm 50 which is adapted for securement to a looped portion of the net 28. Bracket 48 preferably at least partially encircles the upper member 18 for more snug securement thereto in order to prevent wobbling or displacement of the bracket on the upper member during or as a result of use. The bracket 48 also has a degree of variable position mounting on the upper member to raise or lower the position of the game net 28 as desired or to accommodate nets 28 of various heights. Bracket 48 is secured to the member 18 at selected desired locations thereon by means of aperture 52 in bracket 48 which is alignable with a suitably located hole 54 in upper member 18 so that aperture 52 and hole 54 can receive a bolt 56. The hole 54 is preferably threaded so that bolt 56 can be screwed thereinto. There are preferably a plurality of holes 54 so that the bracket 48 may be positioned at various desired locations. In addition, bolt 56 is preferably winged so that it can be manually tightened and loosened. As shown in FIG. 4, a pair of brackets 48 are utilized for the upper and lower corners of the net 28 in order to more securely attach the net 28 to the upper member 18.

Figure 5:
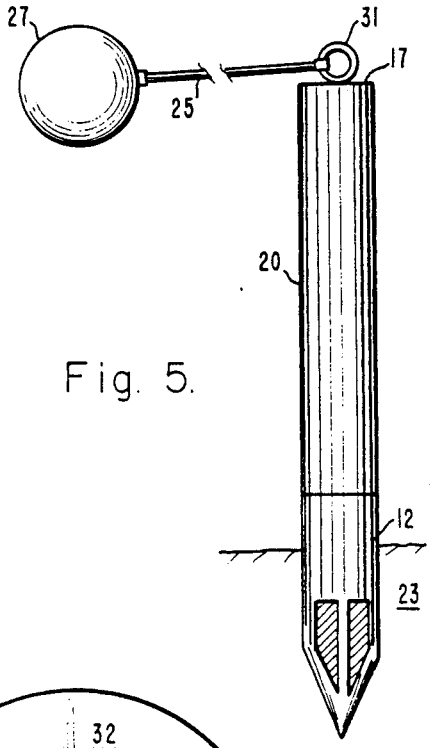
FIG. 5 is an elevational view of the apparatus of the present invention illustrating a fourth upper member designed to support a tether ball game structure.
Figure 6:
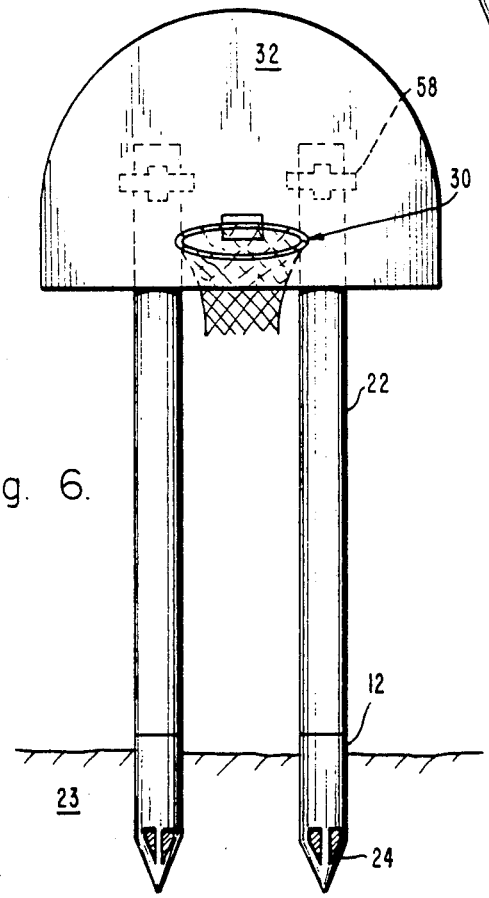
FIG. 6 is an elevational front View of the apparatus of the present invention illustrating a third particular upper member designed for use with a game backboard and utilizing two pairs of upper and lower members supporting the backboard and a basketball net.

The 3rd upper member 20 has a looped member or ring 31 securely mounted at preferably the top surface 17 thereof, as shown in FIG. 5. A tether ball 27 and rope 25 is connected to the ring 31. The member 20 is of a suitable height to accommodate the height and age of the users.

The 4th upper member 22 is detachably secured to a backboard 32 which is in turn secured to a basketball net structure 30.

Member 22 is secured to backboard 32 preferably by means of a bracket 58 mounted on the upper member 22 and firmly affixed to the backboard 32. The bracket 58 preferably has a brace 60 secured thereto. The brace 60 has an aperture 62 which is alignable with a corresponding hole 54 in upper member 22. A bolt 56 passes through the aperture 62 and screws into the threaded hole 54 in order to secure the bracket (and backboard and net) to the upper member 22. The bolt 56 is preferably winged so that it may be manually tightened and loosened. Preferably, there are a plurality of spaced holes 54 at selected locations in the upper member 22 in order to place the bracket 58 (and backboard and net) at any of a plurality of positions on the upper member 22 so that the height of the backboard and net may be adjusted. Optionally, there may also be a lock pin 66 which is received by aperture 64 in extension 68 of brace 60 to enhance securement of the brace 60 and bracket 58 to the upper member 22. The extension 68 is preferably stepped so that it is in contact with the upper member 22. The brace 60 is preferably composed of a flexible material so that the user may pull the brace 60 away from the upper member 22 in order to facilitate adjustment of the position of the bracket on the upper member 22 (to enable the bracket to slide more easily along the upper member 22). Preferably, the brace 60 is firmly secured to the bracket 58 at an approximately medial portion thereof so that pulling the brace 60 will also result in pulling of the bracket 58 (preferably also composed of a flexible material) away from the member 22 to further facilitate adjustment of the position of the bracket 58 on the upper member 22. However, instead of the aforementioned bracket structure, other types of bracket structures or other suitable securement means may also be used.

The upper and lower members 12 and 14 are preferably composed of a lightweight, generally structurally rigid material such as plastic. The members 12 and 14 may also be composed of a suitable lightweight metal such as aluminum or any other suitable material. Alternatively, however, the members 12 and 14 may also be made of PVC pipe manufactured according to the above described requirements.

Instead of a single upper member adapted for each particular game structure, there may be a plurality of upper members "stacked" one on top of another. This would enable the height of the upper and lower members, when assembled, to be adjusted, as desired. In addition, the particular structures of the individual upper members may be combined into a single upper member (or more than one upper member) to reduce the total number of components. For example, the ring 31 on the upper member 20 may be mounted on upper member 22 to allow a single upper member to accommodate both tether hall and basketball game playing activities.

Accordingly, there has been provided, in accordance with the invention, a portable game apparatus that fully satisfies the objectives set forth above. It is to be understood that all terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include all such alternatives, embodiments, modifications, and variations that fall within the spirit and scope of the invention as set forth in the claims hereinbelow.

I claim:

1. A portable kit for supporting multiple outdoor game activities, comprising:

a lower stake member;

a set of upper stake members, each of said set of upper members having a lower end portion mateable with a corresponding upper medial portion of said lower stake member so that said lower stake member and each of said set of upper members can be securely joined together end to end, said lower member having a tapered lower end section so that said lower member and a first one of said set of members can be joined together end to end and driven into a ground surface to allow said lower member and said set to be utilized for playing multiple game activities;

a game structure having a backboard;

a bracket for attaching at least a second one of said set to said backboard so that said lower member and said second one of said set can support a game activity, said bracket being detachably connected to said backboard, said bracket being attached to said second one of said set at any one of selected locations in order to adjust the height of said second bracket and said game structure relative to the ground bracket and said game structure relative to the ground surface;

a brace connected to said bracket; and means for securing said bracket to said second one of said set.

2. The kit of claim 1 wherein said means for securing includes:

said brace having an aperture for receiving a bolt; and said second one of said set having a threaded hole for receiving the bolt so that said brace and said bracket may be attached to said second one of said set.

3. The kit of claim 2 wherein said hole is a plurality of holes at selected locations in said second one of said set so that said bracket may be attached to said second one of said set at any of selected locations thereon in order to adjust the height of said game structure and said bracket relative to the ground surface.

4. The kit of claim 1 wherein said brace is composed of a flexible material so that it can be manually pulled away from said second one of said set in order to facilitate adjustment of the height of said bracket and said game structure relative to the ground surface.

* * * * *